United States Patent [19]

Rammos

[11] Patent Number: 4,749,970

[45] Date of Patent: Jun. 7, 1988

[54] COMPACT ORTHOMODE TRANSDUCER

[75] Inventor: Emmanuel Rammos, Oegstgeest, Netherlands

[73] Assignee: Agence Spatiale Europeenne, Paris, France

[21] Appl. No.: 884,063

[22] Filed: Jul. 10, 1986

[30] Foreign Application Priority Data

Jul. 11, 1985 [FR] France ..... 85 11196

[51] Int. Cl.[4] ..... H01P 1/161

[52] U.S. Cl. ..... 333/125; 333/137; 333/21 A; 333/251

[58] Field of Search ..... 333/122, 125, 137, 21 A, 333/251

[56] References Cited

U.S. PATENT DOCUMENTS

| | | | |
|---|---|---|---|
| 2,792,551 | 5/1957 | Smith | 333/122 |
| 3,048,804 | 8/1962 | Drum | 333/137 |
| 3,958,192 | 5/1976 | Rootsey | 333/125 |
| 4,122,406 | 10/1978 | Salzberg | 333/21 A X |
| 4,126,835 | 11/1978 | Gould | 333/21 A |
| 4,395,685 | 7/1983 | Davies et al. | 333/125 |
| 4,490,696 | 12/1984 | Takeda et al. | 333/137 |

FOREIGN PATENT DOCUMENTS

| | | | |
|---|---|---|---|
| 0176303 | 9/1985 | Japan | 333/125 |

*Primary Examiner*—Gene Wan
*Assistant Examiner*—Benny Lee
*Attorney, Agent, or Firm*—Fred A. Keire

[57] ABSTRACT

Inside a parallelepipedic guide section there is provided at least one partition located so as to divide the inner volume of the guide section into a main waveguide portion capable of supporting an orthogonally polarized signal and two secondary waveguide portions extending in the same direction as the main waveguide portion. The secondary waveguide portions are so dimensioned such that one of these waveguide portions is capable of supporting a horizontally polarized signal and that the second waveguide portion is capable of supporting a vertically polarized signal.

7 Claims, 4 Drawing Sheets

COMPACT ORTHOMODE TRANSDUCER

FIELD OF THE INVENTION

The present invention relates to a waveguide apparatus for microwave signal processing and more especially to apparatus capable of dividing an orthogonally polarized microwave signal into two linearly polarized signals and, in reverse direction, capable of combining two linearly polarized signals into an orthogonally polarized microwave signal.

BACKGROUND OF THE INVENTION

In the art of satellite communications, orthogonally polarized signals are currently used. The modern antennae on board of satellites frequently use multi-horn signal sources to feed reflectors for producing configured or multiple beams. When using orthogonally polarized signals in the feed systems for the multiple sources, the waveguide configurations become very intricate and give rise to implementation problems, especially when a great number of horns are used in a compact configuration (the horn spacing is ranging about the wavelength used). The signals to be divided or to be combined may be located in comparatively large, possibly well separated, different frequency ranges, e.g. 17.7–22.2 GHz and 27.5–31.0 GHz.

In order that a microwave transducer can be used in feed systems comprising a plurality of closely located signal sources a microwave transducer should have as small a cross-section as possible, it should be compact and it should have minimum complexity.

Several types of microwave transducer apparatus are known in the art. The most common apparatus comprises a main waveguide and at least an output waveguide, the axis of which is perpendicular to the axis of the main waveguide. Such a configuration involves assembling problems, especially when a great number of signal sources have to be fed and when the sources are close to each other.

A second type of microwave transducer is disclosed in the U.S. Pat. No. 4,126,835 issued to Gould. This known apparatus uses a septum polarizer that acts to convert a linearly polarized signal into a circularly polarized signal and vice versa. This type of apparatus has not been implemented for linearly polarized signals.

SUMMARY OF THE INVENTION

It is an object of the invention to provide a compact size microwave transducer capable of dividing orthogonally polarized microwave signals into two linearly polarized signals and, in the reverse direction, capable of combining two linearly polarized microwave signals into an orthogonally polarized signal.

This object is achieved in accordance with the present invention by a microwave apparatus comprising a parallelepipedic guide section having first and second opposite open ends, at least one metallic partition located inside the guide section and extending between a first end of said guide section and a transverse cross-sectional plane intermediate the opposite ends of the guide section, said partition being positioned so as to form inside the guide section a first waveguide portion having the same cross-section as the said guide section, said first waveguide portion being capable of supporting two orthogonal polarization modes of signal propagation, and said first waveguide section extending between said transverse cross-sectional plane and said second end of the guide section, and a second waveguide portion and a third waveguide portion having smaller cross-sections than the cross-section of the first waveguide portion, said second and third waveguide portions being so dimensioned that the second waveguide portion is capable of supporting horizontal linear polarization mode of signal propagation and that the third waveguide portion is capable of supporting a vertical linear polarization mode of signal propagation, said second and third waveguide portions extending between said first end of the guide section and said transverse cross-sectional plane; and at least one mode suppressor means positioned in said first waveguide portion so as to cancel an undesirable polarization mode (e.g. the horizontal mode) in one of said second and third waveguide portions. Several inner metal partitions may be provided thereby to define linear polarization mode waveguide portions having tapered cross-section.

The major advantage of the apparatus of the present invention is that it has a compact configuration which embodies a waveguide supporting an orthogonally polarized signal and two waveguides supporting each a linearly polarized signal and which assures a perfect separation between the linearly polarized signals. The apparatus is fully reciprocal. Other features and advantages will become apparent from the disclosure to follow.

DESCRIPTION OF THE INVENTION

Figure 1:
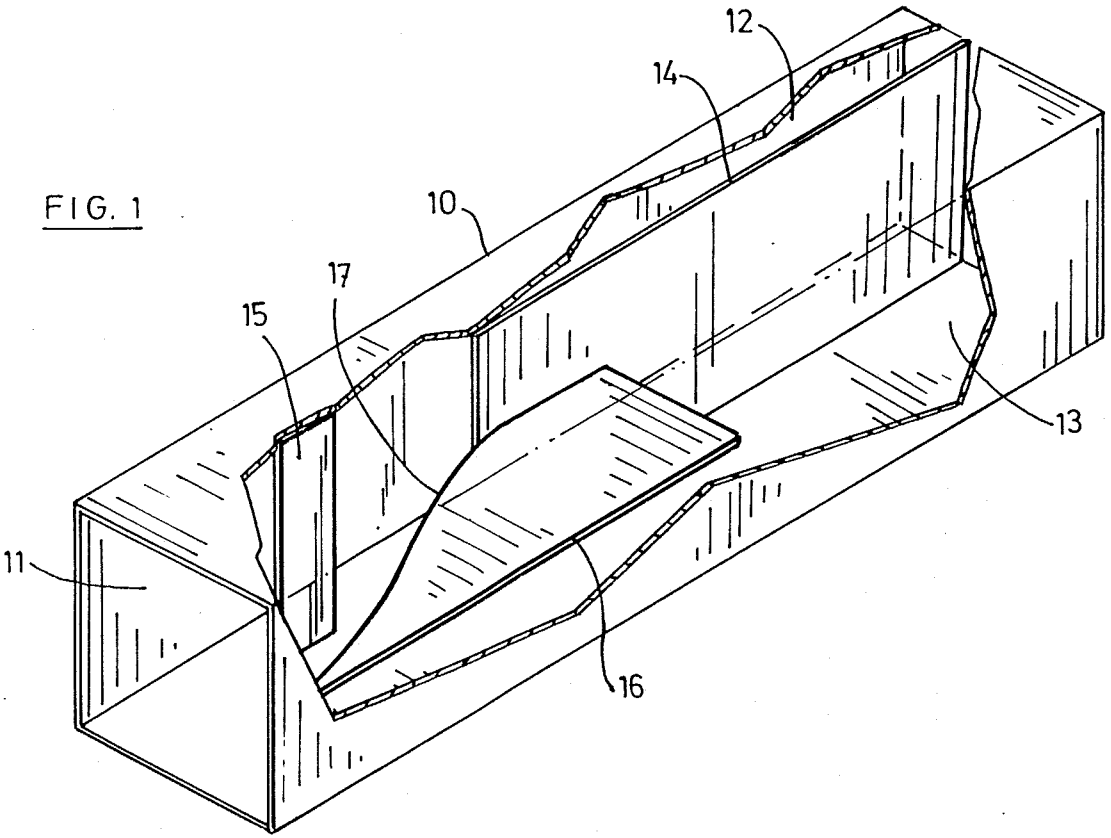
FIG. 1 shows, in partial cutaway, an exemplary apparatus of the invention.

Referring to the drawings, it will be appreciated that the apparatus according to this invention has the general shape of a parallelepipedic guide 10. In the exemplary embodiment depicted in FIG. 1, a vertical metal partition 14 is located inside the guide 10. This partition 14 connects the upper face to the lower face of the guide and extends lengthwise from the right open end of guide 10 to a transverse cross-sectional plane intermediate the opposite open ends of guide 10. The inner volume of the guide 10 is thereby divided into a main waveguide portion 11 having the same cross-section as the guide 10 and two generally parallel secondary waveguide portions 12 and 13 of smaller cross-section than the main waveguide portion 11.

The cross-section of the main waveguide portion 11 (that is the cross-section of the apparatus) is so dimensioned as to permit the main waveguide portion 11 to support two orthogonal polarization modes of signal propagation with horizontal and vertical electric field, respectively, e.g. the TEO1 and TE10 modes. The main waveguide portion 11 is depicted with a square cross-section for clarity of the drawing. The dimensions of the square cross-section are usually $1\lambda \times 1\lambda$ approximately (λ represents the wavelength used for propagation of the electromagnetic wave).

The cross-sections of the secondary waveguide portions 12 and 13 are so dimensioned as to permit the waveguide portion 12 to support horizontally polarized signals and to permit the waveguide portion 13 to support vertically polarized signals. For instance, the rectangular waveguide portion 12 has a cross-section of 1 λ×0.4 λ and the rectangular waveguide portion 13 has a cross-section of 1 λ×0.6 λ. The horizontal dimension (0.4 λ) of waveguide portion 12 prevents the vertically polarized signals of propagating through the waveguide portion 12. A wave signal of horizontal polarization only is thereby produced at the open end of waveguide portion 12. A vertical sheet 15 located in the main waveguide portion 11 provides impedance match between the main waveguide portion 11 and the secondary waveguide portion 13. A plurality of matching sheets may be provided.

Figure 6:
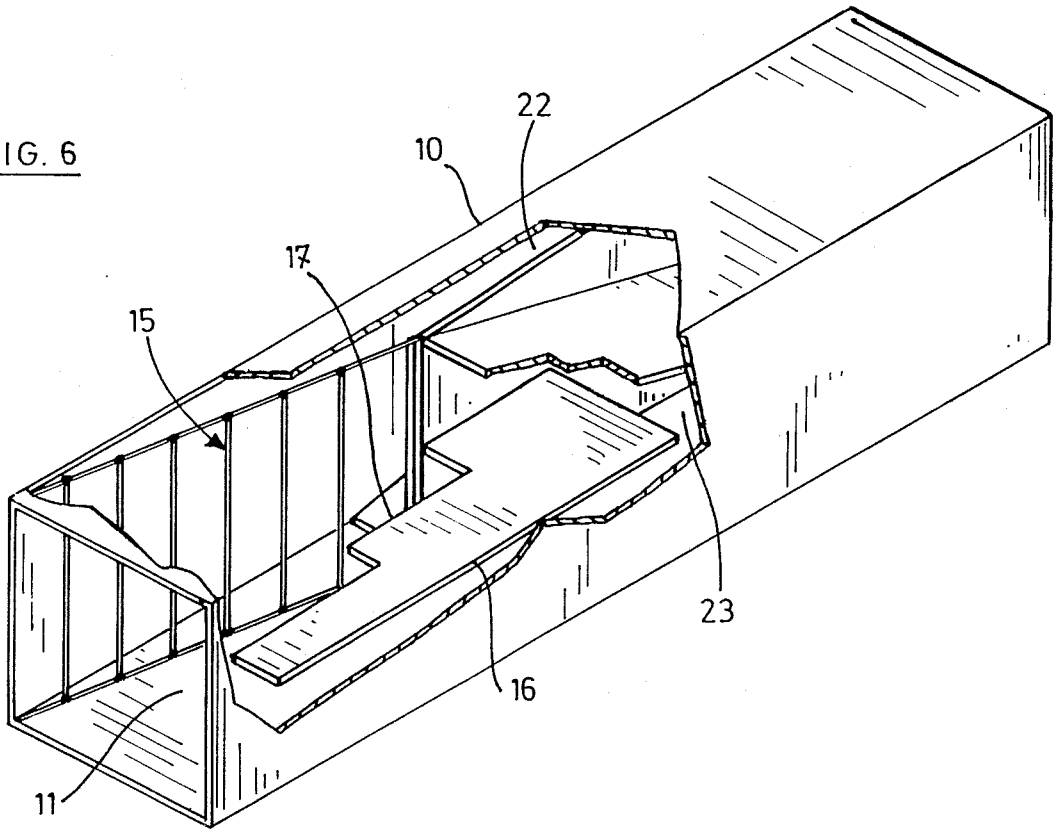
FIG. 6 shows, in partial cutaway, a variation of the embodiment shown in FIG. 2.

The vertical electric field wave signal is allowed to propagate through the waveguide portion 13. In order to suppress the undesirable horizontal electric field wave signal therein, there is provided a mode suppressor means located at the junction between the main waveguide portion 11 and waveguide portion 13. In the embodiment of FIG. 1, said mode suppressor means is comprised of a metal sheet 16 connecting the two vertical walls of waveguide portion 13. The effect of such a suppressor sheet is well known in the art: it serves to deviate the lines of force of the horizontal electric field to bring them parallel to those of the vertical electric field, and creates for the horizontal polarization two waveguide sections below cutoff, the height of each section being less than half a wavelength in view of the width of sheet 16. The sheet 16 has an edge 17 which is so shaped as to optimize suppression of the horizontal polarization mode propagating from the guide 11 to the guide 12 having a different cross-section and such that the vertically polarized signal only propagates through the waveguide portion 13. Advantageously, the edge 17 of the mode suppressor sheet 16 has the shape of a cosine squared curve as shown by way of example in FIG. 1 or is stepped as is shown in FIG. 6.

Thanks to the arrangement of this invention, the horizontally polarized signal and the vertically polarized signal which are launched into the main waveguide portion 11 are thereby efficiently separated for propagation through the two secondary waveguide portions 12 and 13, one of said secondary waveguide portions operating to propagate the horizontally polarized signal while the other of said secondary waveguide portions operates to propagate the vertically polarized signal.

The dimensions of the secondary waveguide portions 12 and 13 and the number and dimensions of the mode suppressor means depend on the frequency bandwidth to be used. The cut-off performance is first achieved for an undesirable polarization mode, and then the sheet dimensions are optimized with regard to the frequency bandwidth used.

There is no need for the two linear polarization mode waveguides to have a constant cross-section as shown for the waveguides 12 and 13 in FIG. 1. An alternative exemplary embodiment is depicted in FIGS. 2 through 5. In this embodiment, both linear polarization mode waveguides 22 and 23 have a tapered cross-section from their junction with the main waveguide portion 11 to their free open end. The two waveguide portions 22 and 23 are defined inside the guide section 10 by the angled inner metal partitions 24 and 25 (see particularly FIG. 5), whereby each partition forms two inner faces of a tapered rectangular waveguide portion. The operation of this structure is quite similar to that of the structure of FIG. 1: the orthogonal polarization modes in the main waveguide 11 are separated in the secondary waveguides 22 and 23, the horizontally polarized signal propagating through waveguide 22 and the vertically polarized signal propagating through waveguide 23. One of the secondary waveguides may be rotated by 90° thereby to realize two waveguides with parallel electric fields. Also one of the linear polarization mode waveguides may be defined by an angled inner partition while the other one is defined by a planar inner partition.

Figure 2:
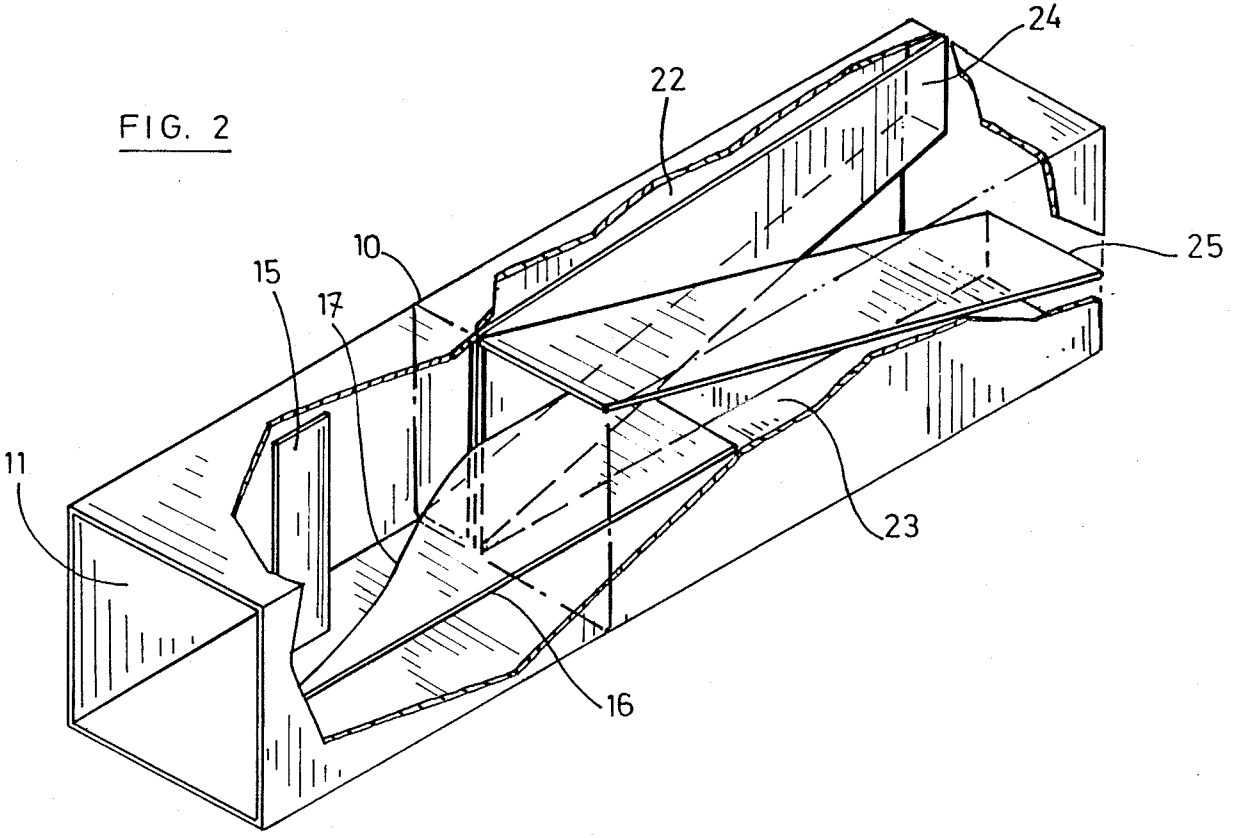
FIG. 2 shows a second exemplary embodiment of the apparatus of the invention.
Figure 3:
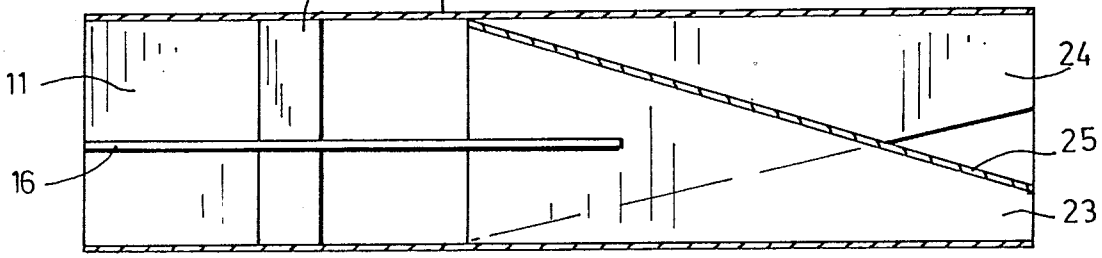
FIG. 3 is a sectional side view of the apparatus of FIG. 2.
Figure 4:
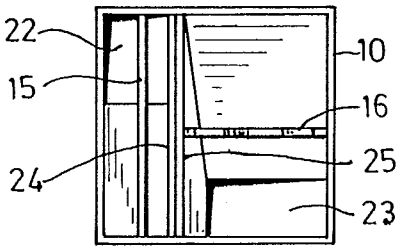
FIG. 4 is a left-hand side view of the apparatus of FIG. 2.
Figure 5:
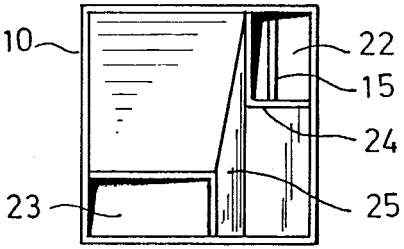
FIG. 5 is a right-hand side view of the apparatus of FIG. 3.

FIG. 6 illustrates a variant to the structure shown in FIG. 2. The variation is concerned with the arrangement for the impedance matching means 15 and the arrangement for the mode suppressor means 16. In the embodiment of FIG. 6, the impedance matching means is comprised of a plurality of metal wires which have proved to be more efficient than the vertical sheet of FIG. 2. As for the horizontal sheet 16, it is arranged with a stepped edge 17 with a view to assist in optimizing the horizontal polarization matching performance.

It is clearly apparent from the appended drawings that the apparatus of this invention exhibits a compact integrate structure having the cross-section of the main waveguide over its entire length. In this structure, the linear polarization waveguides extend in the same direction as the orthogonal polarization waveguide. Such a compact waveguide structure is used with advantage in the feed systems for the primary sources of satellite antennae.

Other advantages of the apparatus of this invention include: ease of manufacturing, possibility of achieving a good transition between two waveguides having different cross-sections, possibility of using different and separate frequency ranges for the two polarization modes, capability of producing well isolated signals in two linear polarization modes.

What is claimed is:

1. A compact orthomode transducer for splitting a linear orthogonally polarized signal into a plurality of linearly polarized frequency components, said transducer comprising:

a parallelepipedic guide section having a constant cross-section perpendicular to a lengthwise direction of said guide section and first and second lengthwise opposed open ends;

at least one metal partition located inside the guide section and extending lengthwise from said first end of said guide section to a transverse cross-sectional plane intermediate the opposed ends of the guide section, said partition being positioned so as to form inside the guide section;

a first waveguide portion having the same cross-section as said guide section, said first waveguide portion being capable of supporting two orthogonal linear polarization modes of signal propagation, and said first waveguide section extending between said transverse cross-sectional plane and said second end of the guide section, and a second waveguide portion and a third waveguide portion having respective, different cross-sections smaller than the cross-section of said first waveguide portion, said different cross-sections of said second and third waveguide portions being respectively so dimensioned that the second waveguide portion is capable of supporting a horizontal linear polarization mode of signal propagation and that the third waveguided portion is capable of supporting a vertical linear polarization mode of signal propagation, said second and third waveguide portions each extending between said first end of the guide section and said transverse cross-sectional plane; and at least one mode suppressor means positioned lengthwise in said first waveguide portion and aligned in a plane different from the plane of said partition so as to cancel one undesirable polarization mode in a selected one of said second and third waveguide portions.

2. An apparatus according to claim 1, wherein the mode suppressor means is a metal sheet arranged with an edge having the shape of a co-sine squared curve.

3. An apparatus according to claim 2, wherein said metal sheet is horizontal.

4. An apparatus according to claim 1, further comprising means for providing an impedance match between said first waveguide portion and a further selected one of said second and third waveguide portions.

5. An apparatus according to claim 1, further comprising at least one further metal partition inside said guide section and extending lengthwise between said first end of said guide section and said transverse cross-sectional plane therby to form with said first-mentioned partition inner faces of at least one tapered linear polarization mode waveguide.

6. An apparatus according to claim 1, wherein said mode suppressor means is perpendicular to said partition.

7. An apparatus according to claim 1, wherein the mode suppressor means is a metal sheet having a stepped edge.

* * * * *